United States Patent [19]

Singer

[11] 4,267,888

[45] May 19, 1981

[54] METHOD AND APPARATUS FOR POSITIONING A TREATING LIQUID AT THE BOTTOM OF A WELL

[76] Inventor: Mortimer Singer, 2320 Plaza del Grande, Las Vegas, Nebr. 89102

[21] Appl. No.: 94,381

[22] Filed: Nov. 15, 1979

[51] Int. Cl.[3] ..... E21B 37/00

[52] U.S. Cl. ..... 166/312; 166/68; 166/112; 417/431

[58] Field of Search ..... 166/68, 68.5, 69, 112, 166/304, 305 R, 311, 312; 417/431; 137/599

[56] References Cited

U.S. PATENT DOCUMENTS

| | | | |
|---|---|---|---|
| 1,075,261 | 10/1913 | Kilburn | 417/431 |
| 2,258,615 | 10/1941 | Kendrick | 166/68 |
| 2,300,348 | 10/1942 | Dana | 166/112 X |
| 2,731,171 | 1/1956 | Mankin et al. | 137/599 X |
| 3,014,531 | 12/1961 | Weaver | 166/304 X |
| 3,071,189 | 1/1963 | Colvin et al. | 166/68 |
| 3,085,629 | 4/1963 | Henderson | 166/304 X |
| 3,102,590 | 9/1963 | Grounds | 166/68 |
| 3,247,798 | 4/1966 | Glasgow et al. | 166/68.5 |
| 4,011,906 | 3/1977 | Alexander et al. | 166/304 X |

*Primary Examiner*—Stephen J. Novosad

*Attorney, Agent, or Firm*—Daniel Silverman

[57] ABSTRACT

This invention relates to a method and apparatus for positioning a selected liquid at the bottom of a well, such as an oil well, while having in the well at least a string of tubing, a rod pump, a string of rods, and a standing valve, without disturbing the rods, pump, tubing or standing valve. A bypass conduit is connected through the wall of the tubing at a point above the pump and is carried down, outside the tubing to a point below the conventional mud anchor, into the inlet of an overpressure valve. The outlet of the valve empties into the well annulus. If the normal pressure at the bottom of the tubing due to the head of liquid in the tubing is P, the overpressure valve is set to open at a pressure of P+P1, where P1 is a selected valve, such as say 100 psi. At the surface, means are provided to close off the top of the tubing. Means are provided to inject the selected liquid into the top of the tubing at a selected pressure P2 above atmospheric, where P2 may be say 150 psi. This causes the pressure at the bottom of the tubing to rise to P+P2. Since P+P2 is now greater than P+P1, the overpressure valve will open and pass as much liquid as is pumped into the tubing at the surface.

11 Claims, 3 Drawing Figures

METHOD AND APPARATUS FOR POSITIONING A TREATING LIQUID AT THE BOTTOM OF A WELL

BACKGROUND OF THE INVENTION

1. Field of the Invention

This invention lies in the field of wells, such as oil well, and, more particularly, wells which carry a string of tubing and are pumped by sucker rod pumps installed in the tubing.

Still more particularly, it concerns wells which produce water, which carries chemicals, which precipitate out in the pores and on the face of the producing formation and in the pumping equipment. This precipitate material must be removed by frequent treatment with various chemicals, including acids, etc. as well known in the art.

The problem is to place the selected volume of treating liquid in the bottom of the well without disturbing the pipe and rods and other equipment in the well.

2. Description of the Prior Art

The present methods of positioning the quantity of treating liquid on the bottom of the well involves, at the least, removing the sucker rods, pump plunger, and standing valve, and pumping by means of a pump truck the treating liquid into the top of the tubing, and flowing out of the tubing at the perforated nipple. At the most, it involves also removing the tubing and positioning the treating liquid into the bottom of the casing by more complicated and expensive means. These processes are very expensive and time consuming, and cannot be afforded on wells with low production, particularly when such wells require frequent treating. This often leads to the early abandonment of the wells, and the loss of all potential future production—a very high price to pay.

The first method outlined above, being the least costly method, is the method most often used. But it still costs a very significant amount for certain types of wells, and also represents a loss of production during the time that the well is shut down, etc.

The present invention is directed to a method and apparatus for accomplishing this treatment process in a more efficient and less costly manner.

SUMMARY OF THE INVENTION

It is a primary object of this invention to provide a method and apparatus for placing a selected volume of a selected liquid in the bottom of a well having tubing, rod pump, rods, and standing valve, without disturbing the rods, pump, tubing or standing valve.

It is a further object of this invention to provide in a well having tubing, rods, rod pump, and standing valve, a method and apparatus for positioning a slug of treating liquid of selected size at any point along the length of the tubing.

These and other objects are realized, and the limitations of the prior art are overcome in this invention by the installation of a bypass conduit along the outside of the tubing. The top of the bypass enters the wall of the tubing above the pump. The bottom end is preferably below the lowest portion of the equipment hanging on the string of tubing. The bottom end leads into an overpressure valve which is attached to the lowermost portion of the tubing. Thus the bypass conduit carries liquid from the tubing above the pump down to the overpressure valve and bypasses the two check valves in the traveling valve and the standing valve.

Let the pressure in the tubing be P, which is the hydrostatic head of the column of liquid in the tubing. The overpressure valve is set to open at a value of P+P1, where P1 is a selected value of overpressure, say 100 psi. So as long as the pressure in the tubing is P, the valve will not open.

To open the valve, the tubing is closed at the top and means are provided to inject the selected fluid into the tubing at a selected pressure of P2 above atmospheric pressure when the surface pressure is raised to P2, then the pressure P increases to P+P2. Since this is greater than P+P1, the valve will open and pass liquid as long as the pressure P2 is applied by continuing injection of liquid. The volume of liquid bypassed through the valve will be equal to the volume injected at the top of the tubing.

When the volume of liquid injected is equal to the internal volume of the string of tubing, all of the original well liquid which had been standing in the tubing will be emptied into the well annulus, and the tubing will be filled with treating liquid. To get this treating liquid from the tubing into the well, an additional volume of pusher liquid is injected. Then all of the treating liquid will be in the well bore. The pusher liquid can be any liquid, but is preferably oil from the field tank, since when the rod pump is again started, this liquid will be pumped back into the field tank.

By selecting volumes of treating liquid and pusher liquid, a slug of treating liquid can be positioned at any desired point in the tubing.

This method and apparatus can be applied to wells of any depth that are being pumped by sucker rod pumps. The cost of equipping shallow or deep wells is about the same, while the potential saving in service costs goes up very rapidly with increased depth. So the method is economically more attractive in deep wells.

BRIEF DESCRIPTION OF THE DRAWINGS

These and other objects and advantages of the invention, and a better understanding of the principles and details of the invention will be evident from the following description, taken in conjunction with the appended drawings, in which.

DESCRIPTION OF THE PREFERRED EMBODIMENT

Figure 1:
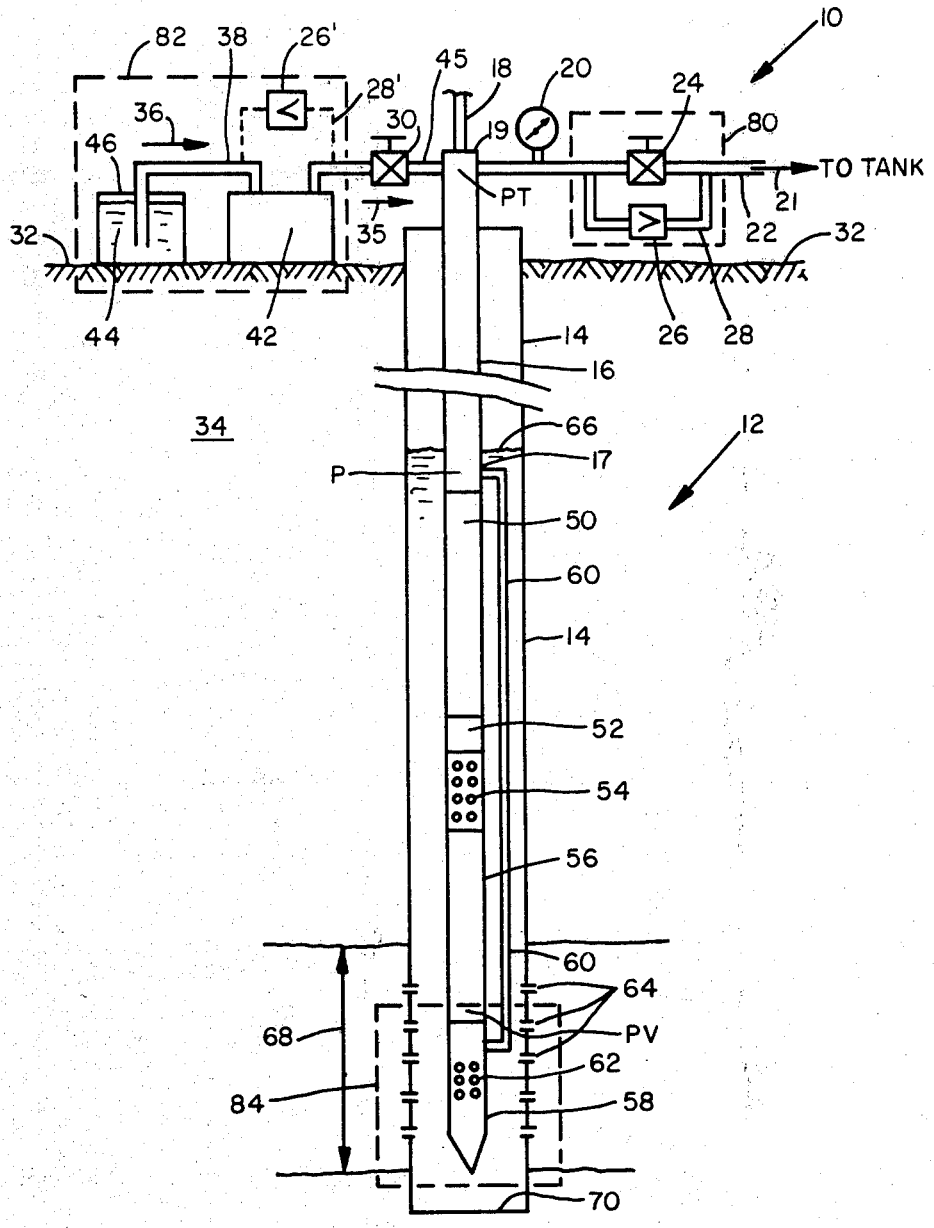
FIG. 1 is a schematic illustration of the conventional surface and downhole apparatus for pumping oil wells, indicating those parts of the system which are novel and form this invention.

As shown in FIG. 1, this invention comprises a system, including a surface apparatus coacting in a known manner with a downhole apparatus. The surface apparatus is indicated generally by the numeral 10, while the downhole apparatus is indicated generally by the numeral 12.

Much of the apparatus shown in FIG. 1 is old and conventional. The new parts are contained within the dashed boxes 80, 82 at the surface, and 84 at the bottom of the hole, and a fourth element is the bypass pipe or conduit 60.

Box 80 is identified as a means to close off the top end of the tubing. Box 82 is identified as a means to inject a selected liquid into the closed off top of the tubing, at a selected pressure. Box 84 is a first overpressure (relief) valve, and pipe 60 is a bypass connecting from an opening in the tubing above the rod pump, down to the overpressure valve 84. The rest of the system can be conventional.

The rest of the system includes a well, such as an oil well, including a casing 14, a string of tubing 16 extending down to a point near the bottom of the casing, a string of sucker rods 18, a sucker rod pump 50, a coupling 52 housing the standing valve, a perforated nipple 54, and a mud anchor 56. As previously mentioned, all these parts are conventional, and are used on most pumping wells. Of course, another arrangement of parts can be used, which will operate just as well with this invention. The only requirement is that fluid inside the tubing can pass through an opening 17 in the tubing 16, into the bypass conduit 60 down to an overpressure valve 84.

When the equipment is in normal use, operating means (not shown, but well known in the industry) is provided to alternately raise and lower the sucker rods 18, through a selected distance, on a selected time schedule. The bottom end of the sucker rods is connected to the plunger 102 in the pump 50, and the plunger is movably sealed inside of the barrel of the pump 50. The length of the barrel is, of course, longer than the travel distance of the rods and plunger.

There is a check valve in the plunger, called the traveling valve, which, on the downstroke of the plunger permits well fluid to pass through the valve from the space below, to the space above, the plunger. On the upstroke of the plunger the valve closes and the plunger, lifted by the rods, lifts the entire column of well fluid in the tubing, from the plunger up to the surface.

As the plunger moves up, the space below the plunger has a greatly reduced pressure, and the pressure head of the fluid standing in the annulus, forces well fluids from the annulus in through the openings in the perforated nipple 54, up through the check valve, the standing valve, in the coupling 52 below the pump 50. Thus, the pair of check valves, in combination with the stroking of the plunger, lifts fluid from the annulus, up the string of tubing 16 to the surface, where it passes through the gathering line pipe 22 to the field tank, (not shown but well known in the industry).

In the course of well operations many troubles can occur. For example, the water in the oil formation may contain certain chemicals in siolution in the pores of the rock, but under the reduced pressure in the well annulus, these chemicals precipitate from solution and deposit inside the pores of the rock, and on the rock wall, or face. After a time these deposits become heavy enough to coat the walls and greatly reduce the flow of liquid into the well. It then becomes necessary to position a batch of treating liquid on the bottom of the well. There are many such treating liquids known to the industry. The particular liquid forms no part of this invention. The invention is concerned with apparatus for facilitating this placement of treating liquid.

From the above description of the apparatus, it will be clear that such liquid can be poured down the well annulus from the surface. This is a very unsatisfactory method for many reasons. It is clear also that it is impossible to pour liquid down the tubing, because the passage is closed by two check valves. The most satisfactory way is to pull the sucker rods, pump, standing valve and tubing, and to place the liquid on the bottom by means of a pump truck. This is a very expensive and time consuming method.

A less satisfactory, though practically useful method is to pull rods, plunger and standing valve. The fluid in the tubing will then flow out the bottom end of the tubing, outwardly through the perforated nipple, into the annulus. Now the selected liquid can be pumped down the tubing into the annulus. This method is much less expensive and time-consuming than the first method, but it is too expensive to justify for frequent operations. A simpler and cheaper method is required.

The apparatus and method of this invention will be described in detail in connection with FIGS. 2 and 3. However, the following over-view will make the description more understandable.

A small opening 17 is cut through the wall of tubing 16, just above the pump 50. Bypass conduit 60 is sealed into this opening 17, and is carried down to a point below the mud anchor 56. This bypass cannot be left open, since it would prevent the pump from pumping. In fact, all the fluid in the tubing would flow down the tubing through the bypass into the annulus. Of course, the bypass is needed as a way to get past the two check valves. The bypass is closed on its bottom end by an overpressure valve 58.

There is a normal pressure P inside the tubing at the position of the opening, which represents the pressure head of the column of fluid. So the overpressure valve 58 must be set to open at some selected pressure, PV, greater than P, by an additional pressure P1, where P1 is say, for example, 100 psi. Thus, $PV=P+P1$, where $P1 \cong 100$ psi.

Now the overpressure valve 58 will keep the bottom end of the bypass 60 closed at all times during normal operation of the pump. If it is desired to open the bypass, the pressure at opening 17 must be raised from P to a pressure higher than PV. This is done by closing off the tubing at the surface by closing valve 24 (which is normally open during pumping, and injecting liquid through pipe 45, into the tubing at a selected pressure P2. If P2 is set to be say, 150 psi above atmospheric, then the bottom of tubing pressure will be $P+P2$, or $P+150$. Since $PV=P+100$, this excess pressure will open the overpressure valve, and it will pass a volume of liquid equal to that injected at the surface, by the means to inject, 82. This means 82 can comprise a conventional pump 42 and tank 46 of treating liquid 44. This liquid will flow in pipe 38 in the direction of arrow 36 to the pump inlet, and from the pump outlet through pipe 45 to the tubing 16 in accordance with arrow 35. The valve 30 is normally closed when the well is pumping and provides a quick connection into the interior of the tubing.

It will be clear that while this injection of liquid is taking place the normal operation of the rods and pump are stopped.

It will be clear also, that whenever the rod pump is stopped, the tubing remains filled with well fluid. Thus when fluid 44 is injected into the top of the tubing, none of it reaches the annulus through the overpressure valve 58, until all of the well fluid standing in the tubing first empties into the annulus. Also when the selected volume of fluid 44 is injected into the tubing, the tubing will be full of the fluid 44, until an additional volume of a driving fluid, such as well fluid, is injected to fill the tubing.

If for any reason the valve 58 should stick, and an overpressure of say 150 psi fails to open it, there is danger that the injection pressure may go high enough to injure the surface equipment. Thus, as a safety measure, it may be desirable to install a bypass 28 around the valve 24, and including a second over-pressure valve 26. If this second overpressure valve 26 is set to open at 200 psi above atmospheric pressure, that will ensure that the injection pressure never exceeds 200 psi.

Instead of the bypass 28 and overpressure valve 26 across the shut-off valve 24, it is possible to place the bypass 28' and overpressure valve 26' (shown by dashed line) between the output and input of the pump 42.

However, the bypass 28 and overpressure valve 26 is worthwhile for another reason. When the rod pump is working the valve 24 must be open so that the lifted fluid can flow to the tank. If the valve 24 is closed for any reason while the rod pump is working, there would be great excess pressure in the tubing, along its full length from top to bottom, and equipment could be badly damaged. Valve 26 is a cheap safety measure.

While the well in FIG. 1 is shown as cased to the bottom and cemented 70, and the casing perforated 64 through the producing zone 68, the casing could just as well be anchored above the producing zone, leaving the latter open.

Also, while the figures show a single bypass conduit or pipe 60, it will be understood that this is a purely schematic representation, and any number of separate pipes may be used, or any other selected design, keeping in mind the need to maintain a minimum overall diameter.

Figure 2:
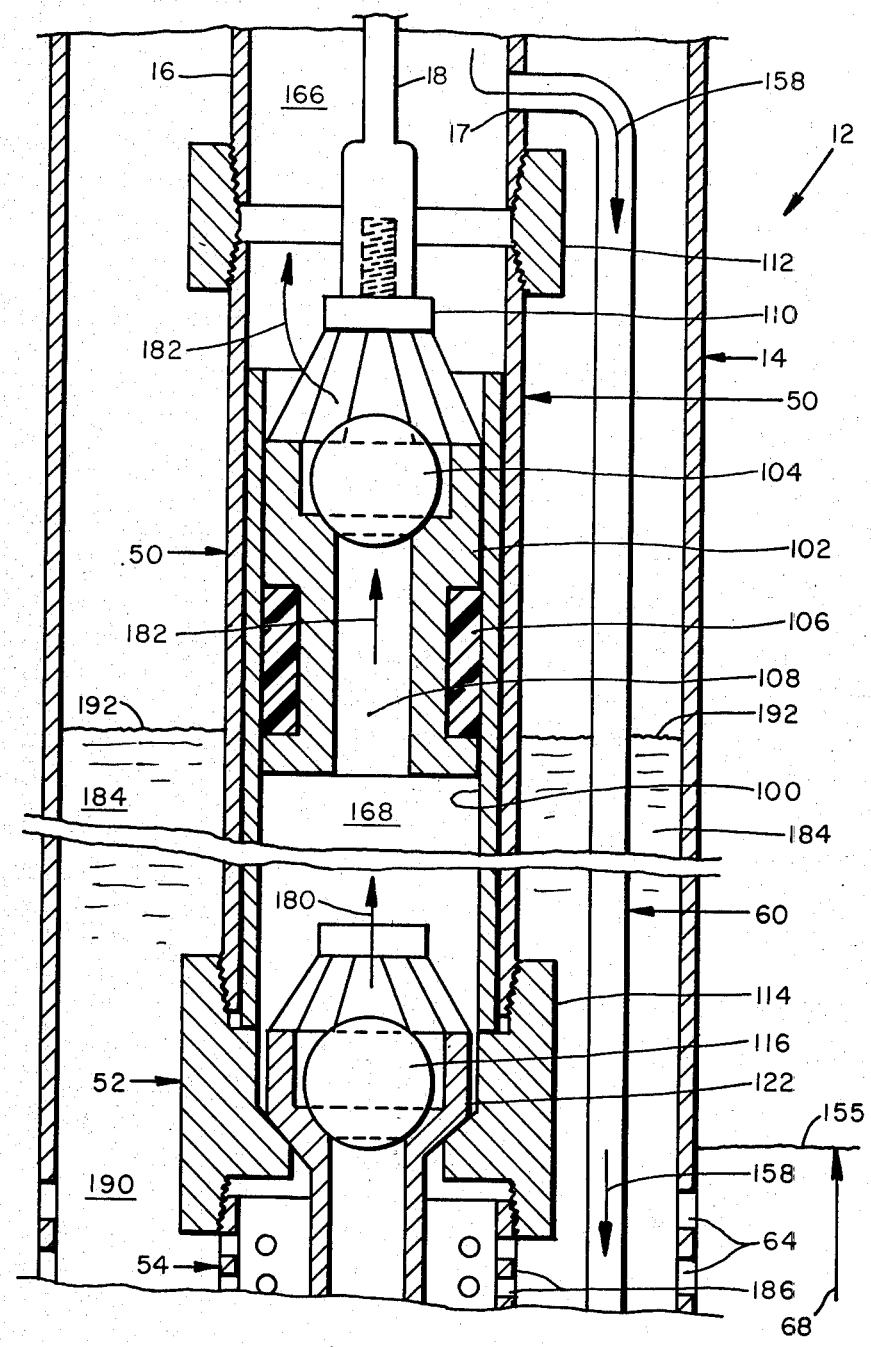
FIGS. 2 and 3 show schematically, in cross-section, one embodiment of this invention as applied to the subsurface apparatus of FIG. 1.
Figure 3:
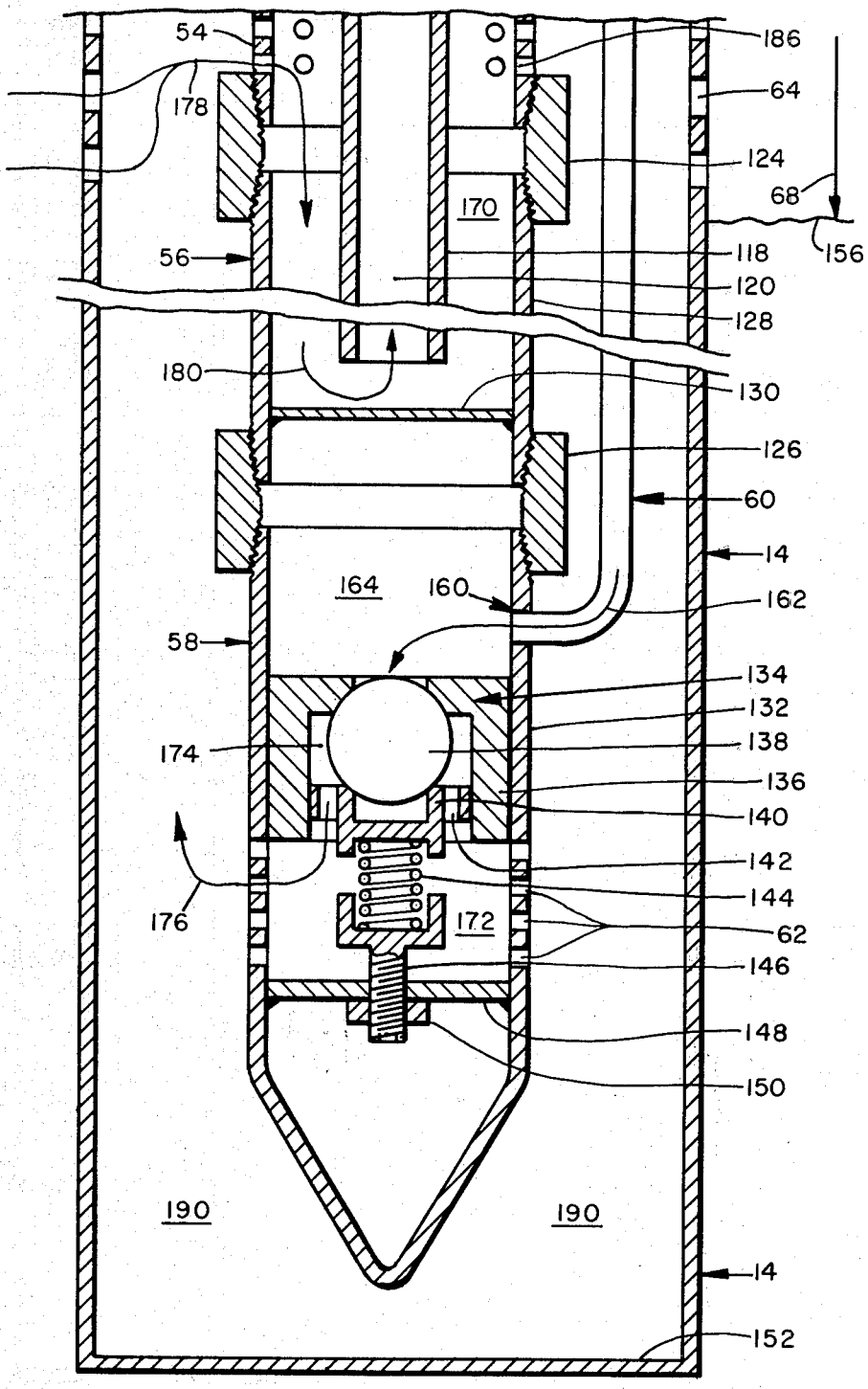

Referring now to FIGS. 2 and 3, there is shown to larger scale and greater detail, in cross-section the apparatus 12, from the position of opening 17 to the bottom of the first overpressure valve 58. FIGS. 2 and 3 fit together, with FIG. 2 above FIG. 3. The total assembly is cut in the middle of the perforated nipple 54, to make the two separate fingers.

Numeral 16 represents the bottom end of the tubing string, which, in the drawing, is cut off just above the small opening 17 in the wall of the tubing. The top end of the bypass 60 is fastened and sealed into the opening 17 by any means, well known in the industry, such as, for example, by welding, threads, etc.

A pump section 50 is supported by and sealed to the bottom end of the tubing by means of threaded coupling 112. This pump section 50 includes a pump barrel 100, which is a thin-walled tube fitted inside the tubing 16, and having on its inner surface a ground and polished cylindrical surface. A pump plunger 102 is fitted inside of the barrel 100, and includes seals 106 of conventional design. The plunger has a central longitudinal opening 108, the top of which is closed by a check valve, or traveling valve 104. The plunger 102 is attached to the bottom end of the rod string 18 by a standard fastening 21.

A special coupling 114 supports as an insert 122 another check valve known as the standing valve 116, which only permits upward flow of well fluid. This insert 122 conventionally carries a long narrow tube 118 which forms the inlet to the pump section 50.

Below the standing valve 116 is a short section of modified tubing known as the perforated nipple 54, which is threaded up into the bottom of coupling 114.

The perforated nipple is shown partly in the bottom of FIG. 2 and the top of FIG. 3. Below the perforated nipple 54 (in FIG. 3) is a length of tubing known as a mud anchor 56. This is closed off at the bottom end by closure wall 130. The mud anchor is long enough to completely enclose the entry pipe 118, so that well fluids in the well annulus, between the tubing string and the casing 14, can flow in accordance with arrows 178 and 180 through the openings 186 in the wall of the perforated nipple 54. The flow is upward through the central opening 120 of the insert 122, up through the check valve 116 into space 168 below plunger. This upward flow in accordance with arrows 180, occurs while the plunger is being lifted by the rods 18.

On the down stroke of the plunger, the bottom valve 116 closes, and the fluid in space 168 cannot move down, so it moves up through the opening 108, through the check valve 104, into the space 166 above the plunger. On the upstroke the valve 104 closes and the plunger, lifted by the rods, lifts the complete column of fluid in the tubing a distance equal to the stroke of the plunger.

Below the mud anchor 56, and attached to it by coupling 126 is an overpressure valve 58. It is a closed tubular chamber 132, preferably pointed on the bottom, and having a plurality of perforations 62 in the lower side wall. In a barrier 136 across the chamber is an inverted check valve. The ball 138 is under the seat, pressed against the seat by a spring 144, through a perforated ring 140. The compression in the spring 144 is adjustable by the threaded rod 146, in the cross member 148. This is an overpressure valve, and any hydraulic pressure in the space 164 above the valve, less than the pressure to which the valve is set, cannot open the valve. An hydraulic pressure in 164 greater than the pressure to which the spring is set will open the valve by pushing the ball down, and passing liquid in accordance with arrow 176, through the perforations 142 in the ring 140 and through the perforations 62 into the well annulus 190.

The bottom end of the bypass conduit 60 passes through and is sealed to an opening 160 in the wall 132 of the overpressure valve.

Consider, in accordance with the preceding comments that the hydrostatic pressure in space 166 at the level of the opening 17 is P, which represents the head of the column of liquid in the tubing. Correspondingly the pressure at the bottom of the bypass, at the level of opening 160 will be a few psi larger (which we can consider). Consider that the overpressure valve 58 is set to $PV=P+P1$, where $P1=100$ psi; for example. So long as the pressure at 17 is P, there is no way that liquid can get past valve 58, and leak from the tubing. However, if (with the pump stopped), the top of the tubing is closed at valve 24, and say that the normal pressure PT at the top of the tubing is atmospheric, but is increased to $PT+150$ psi, then P at level 17 becomes $P+150$. Since this pressure is greater than $PV=P+100$, valve 58 will open and liquid will discharge from space 166 in accordance with arrow 158 through the bypass 60 and into the space 164, and through the valve 138 into the space 172 and through openings 62 into the annulus in accordance with arrow 176. As long as the liquid flow from pump 42 is continued into the tubing through pipe 45, to maintain the overpressure of 150 psi, flow will continue out of the bypass into the annulus. When the overpressure at the top 19 is removed, valve 58 closes. Thus, any desired quantity of selected liquid can be positioned in the annulus by pumping down the tubing and through the bypass without disturbing in any way the string of rods, the rod pump, the standing valve, the perforated nipple, and the mud anchor, or the string of tubing.

As previously mentioned, in the three figures, everything is conventional, except for the apparatus in the dashed boxes 80, 82, 84, and the bypass conduit. Thus the novel elements of this invention can be listed as follows:

(a) an opening in the tubing near to and above the pump;

(b) an overpressure relief valve set to open at a selected fluid pressure on its inlet, positioned in the well in the vicinity of the opening;

(c) conduit means outside of the tubing connected at its first end to the opening, and at its second end to the inlet to the overpressure valve;

(d) at the surface of the well, means to close off the top end of the tubing string; and (e) means to inject at least a selected volume of a selected liquid, into the closed top of the tubing at a selected pressure above atmospheric pressure.

It will be understood that the preceding description of, and method of operation of, this invention is based on low frequency operations, where values of pressure are substantially constant, or vary only by a small fraction of the P1 chosen for the overpressure valve. However, if it should happen that transient pressures arise at the position 17 in the tubing, and could cause momentary opening of the valve 58, this can be effectively stopped by means of a low pass filter, inserted into the bypass.

It will be clear that if it should be desired to place a selected volume of any selected treating liquid at a selected position inside the tubing, say at the bottommost portion of the tubing, or at some intermediate level, or even the entire length of tubing, this can be done by injecting a selected slug of treating liquid, and then injecting a pusher liquid such as oil, and so on. Alternatively, the entire slug of treating liquid can be positioned in the bottom of the well, by making the volume of pusher liquid just enough to fill the tubing, and so on.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim, or claims, including the full range of equivalency to which each element thereof is entitled.

What is claimed:

1. In an oil well having installed at least a string of tubing, a standing valve, a sucker rod pump, and a string of sucker rods, apparatus for positioning a selected volume of a selected liquid in the bottom of said well without disturbing said pump, rods, tubing or standing valve, comprising;

(a) a first opening in said tubing near to and above said pump;

(b) a first overpressure relief valve set to open at a selected fluid pressure on its inlet, positioned in said well below the inlet to said sucker rod pump;

(c) first conduit means outside of said tubing connected at its first end to said first opening, and at its second end to the inlet to said first overpressure valve;

(d) at the mouth of said well, means to close off the top of said tubing string; and (e) means to inject at least a selected volume of a selected liquid, into said closed end of said tubing at a selected pressure above atmospheric pressure.

2. The apparatus as in claim 1 in which said first overpressure valve is positioned below the lower-most portion of said tubing.

3. The apparatus as in claim 1 in which said top of said tubing includes a second conduit means connected to a receiving tank, through which well liquids pumped to the surface, are carried to said receiving tank, and including a first shut-off valve in said second conduit means.

4. The apparatus as in claim 3 including a second overpressure valve set to open at a selected fluid pressure on its inlet, said second overpressure valve connected in a bypass around said first shut-off valve, with its inlet facing toward the top of said tubing.

5. The apparatus as in claim 1 in which said means to inject comprises a pump means with its outlet connected to the top of said tubing and with its inlet connected to a supply of selected liquid.

6. In an oil well having at least a string of tubing, a standing valve, a sucker rod pump, and a string of sucker rods; and an opening in said tubing above said sucker rod pump, said opening connected to an over-pressure valve, set to open at a selected fluid pressure $PV=P+P1$ on its inlet; where P is the normal hydrostatic pressure in the tubing at said opening, and P1 is a selected small value of pressure;

the method of positioning a selected first volume of a selected first liquid in the bottom of said well without disturbing said pump, rods, tubing, or standing valve, comprising:

(a) with said sucker rods not pumping, closing off the top end of said tubing string;

(b) injecting at least said selected first volume of a selected first liquid into the top of said tubing string, at a selected pressure P2 above atmospheric pressure, where $P2>P1$, and where the sum of P2 Plus P the normal pressure head of liquid in said tubing at said opening is greater than $PV=P+P1$;

whereby said first overpressure valve will open and discharge an equal volume of liquid through said opening; and (c) injecting at least a selected second volume of at least a selected second liquid into the top of said tubing at said pressure P2.

7. The method as in claim 6 in which said selected volume of said second selected liquid is at least equal to the volume of liquid standing in the tubing string;

whereby said first volume of first liquid will be discharged through said first overpressure valve into the bottom of said well.

8. The method as in claim 6 in which said overpressure valve is positioned below the inlet to said sucker rod pump.

9. The method as in claim 6 in which said overpressure valve is positioned below the lowermost portion of said tubing.

10. In an oil well having at least a string of tubing, a standing valve, a sucker rod pump, and a string of sucker rods;

an opening in said tubing above said sucker rod pump, said opening connected to an overpressure valve positioned below the intake of said sucker rod pump, said over-pressure valve set to open at a selected fluid pressure PV=P+P1 on its inlet; where P is the normal hydrostatic pressure in the tubing at said opening, and P1 is a selected small value of pressure;

the method of positioning a selected first volume of a selected first liquid in the bottom of said well without disturbing said pump, rods, tubing or standing valve, comprising the steps of;

(a) with said sucker rods not pumping, closing off the top end of said tubing string;

(b) injecting at least said selected first volume of a selected first liquid into the top of said tubing string, at a selected pressure P2 above atmospheric pressure, where P2>P1, and where the sum of P2 plus P the normal pressure head of liquid in said opening is greater than PV=P+P1;

whereby said first overpressure valve will open and discharge an equal volume of liquid through said opening.

11. The method as in claim 10 including the additional step of;

(c) injecting at least a selected second volume of at least a selected second liquid into the top of said tubing at said pressure P2.

* * * * *